US005090189A

United States Patent [19]

Wey et al.

[11] Patent Number: 5,090,189

[45] Date of Patent: Feb. 25, 1992

[54] METHOD AND APPARATUS FOR PREPARING A YARN PACKAGE FOR A SUBSEQUENT YARN RESTARTING OPERATION

[75] Inventors: Edmund Wey, Nettetal; Manfred Anderheggen; Hans Grecksch, both of Monchen-Gladbach, all of Fed. Rep. of Germany

[73] Assignee: Zinser Textilmaschinen GmbH, Ebersbach/Fils, Fed. Rep. of Germany

[21] Appl. No.: 591,447

[22] Filed: Oct. 1, 1990

[30] Foreign Application Priority Data

Sep. 30, 1989 [DE] Fed. Rep. of Germany ..... 3932727

[51] Int. Cl.[5] ..... D01H 13/26; D01H 9/00; D01H 13/14

[52] U.S. Cl. ..... 57/261; 57/262; 57/279

[58] Field of Search ..... 57/261, 262, 269, 278, 57/304, 305, 75, 279

[56] References Cited

U.S. PATENT DOCUMENTS

| | | | |
|---|---|---|---|
| 3,546,870 | 12/1970 | Schewe et al. | 57/262 |
| 3,591,951 | 7/1971 | Kanegafuchi | 57/34 |
| 3,905,187 | 9/1975 | Harmon et al. | 57/305 X |
| 4,432,197 | 2/1984 | Ueda et al. | 57/261 |
| 4,570,433 | 2/1986 | Nickolay | 57/261 X |
| 4,724,665 | 2/1988 | Raasch et al. | 57/261 X |
| 4,729,216 | 3/1988 | Rohner et al. | 57/261 X |
| 4,878,344 | 11/1989 | Igel | 57/261 |
| 4,920,739 | 5/1990 | Raasch | 57/263 |
| 4,970,855 | 11/1990 | Brennwalder et al. | 57/261 |

FOREIGN PATENT DOCUMENTS

| | | |
|---|---|---|
| 2004669 | 8/1971 | Fed. Rep. of Germany . |
| 2351312 | 4/1975 | Fed. Rep. of Germany . |
| 2501338 | 7/1975 | Fed. Rep. of Germany . |

*Primary Examiner*—Daniel P. Stodola
*Assistant Examiner*—Michael R. Mansen
*Attorney, Agent, or Firm*—Shefte, Pinckney & Sawyer

[57] ABSTRACT

A method and apparatus for preparing a yarn package for a subsequent yarn restarting operation are provided. The apparatus includes an air jet for directing a tangential stream of pressurized air against a yarn package to effect loosening of a length of auxiliary yarn which has been wound on the yarn package during a prior unsuccessful yarn restarting operation in which the auxiliary yarn length failed to piece with the yarn still to be wound onto the yarn package. The air jet operates in cooperation with a suction conduit to completely unwind the unsuccessfully pieced auxiliary yarn length from the yarn package to thereby prepare the yarn package for receiving another length of auxiliary yarn during a subsequent yarn restarting operation. According to one aspect of the invention, the auxiliary yarn travels over a roller supported at the free end of a delivery arm mounted on a traveling service unit and the roller is selectively disposable in rotation transmitting engagement with the lower roller of a roller pair of the drafting device to effect feeding of the auxiliary yarn onto the yarn package. If the auxiliary yarn has not successfully pieced with the still-to-be-wound yarn after a predetermined lapse of time, the roller on the delivery arm is positioned against an upper roller of a roller pair of the drafting device to effect unwinding of the auxiliary yarn previously wound onto the yarn package.

9 Claims, 1 Drawing Sheet

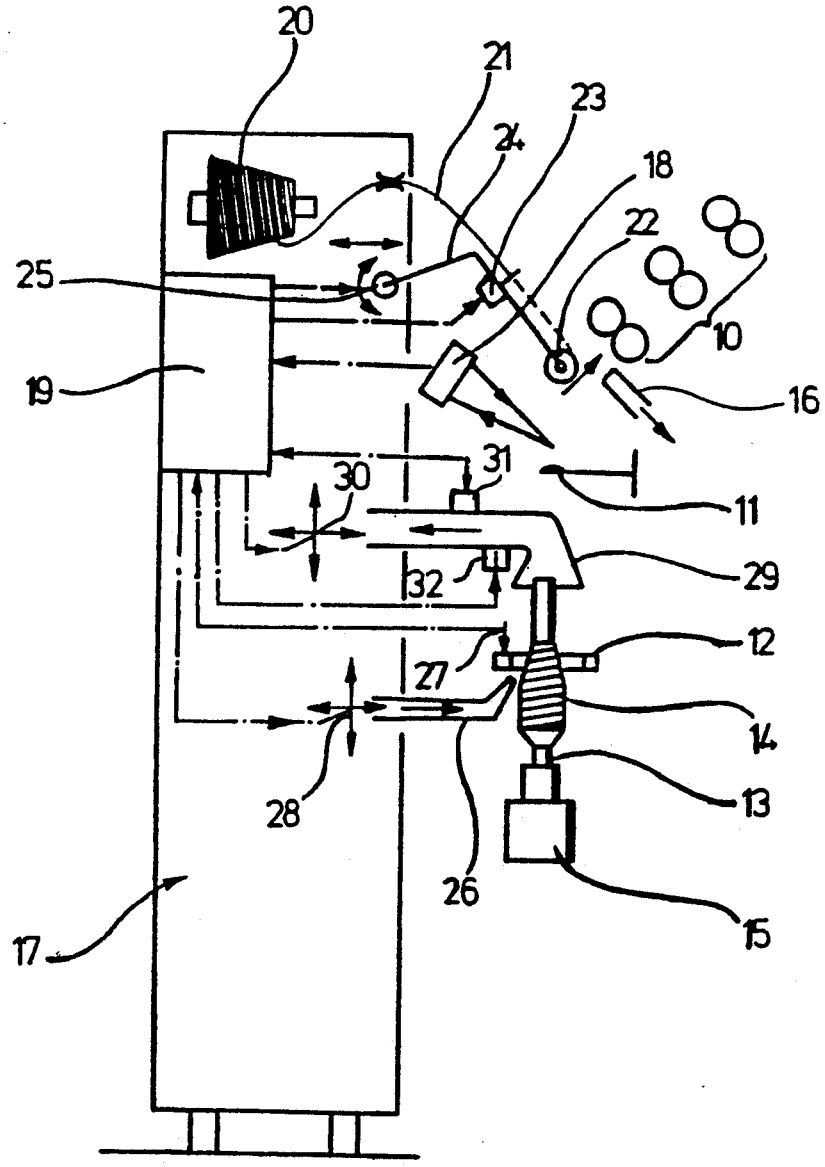
20
21
23
24
18
22
25
10
19
16
31
30
11
29
32
12
27
14
28
13
26
15
17

METHOD AND APPARATUS FOR PREPARING A YARN PACKAGE FOR A SUBSEQUENT YARN RESTARTING OPERATION

BACKGROUND OF THE INVENTION

The present invention relates to a method and apparatus for preparing a yarn package for subsequent yarn restarting operation and, more particularly, to a method and apparatus for removing an auxiliary yarn disposed on a package following a prior unsuccessful yarn restarting operation in which the auxiliary yarn was not successfully pieced with still-to-be-wound yarn.

German Offenlegungsschrift 17 85 236 and German Auslegeschrift 23 51 312 each disclose a method for automatically restarting the feed of yarn from a drafting device onto a package supported at a spinning station of a ring spinning machine following a yarn break thereat. In each disclosed method, auxiliary yarn from an auxiliary yarn supply carried on a traveling service unit is drawn and is simultaneously wound onto the package and pieced with the still-to-be-wound yarn which has been drafted through the drafting device. The length of auxiliary yarn is eventually cut after a predetermined period of time during which successful piecing of the auxiliary yarn with the still-to-be-wound yarn has presumably occurred.

Such yarn restarting operations including the use of auxiliary yarn offer time-saving advantages over yarn restarting operations in which the end of the yarn already wound on the package is first located to restore the yarn to its unbroken condition. However, yarn restarting operations including the use of an auxiliary yarn can lead to operational problems during subsequent handling of the packages on which the auxiliary yarn is wound such as, for example, during subsequent winding of the package at the winding station of a textile winding machine. For example, an operational problem can later arises if an initial attempt to piece the auxiliary yarn with the still-to-be-wound yarn did not succeed. Since the auxiliary yarn is typically cut after a predetermined lapse of time whether or not the auxiliary yarn has successfully pieced with the still-to-be-wound yarn, the cut length of auxiliary yarn is merely itself wound on the package in such instances without drawing the still-to-be-wound yarn onto the package as well. Thus, the feed of the still-to-be-wound yarn has still not been successfully restarted and the package now includes the yarn end of the yarn wound prior to the yarn break as well as the yarn end of the cut length of the unsuccessfully pieced auxiliary yarn. There is an increased risk with such yarn packages having two free yarn ends that both yarn ends will be simultaneously engaged during subsequent handling of the yarn package by an automatic yarn end preparation device, thereby leading to the occurrence of loops and other undesired consequences. Even if the subsequent yarn end preparation process is successful, the relatively short length of auxiliary yarn is relatively rapidly unwound from the yarn package so that a yarn break occurs relatively shortly after the beginning of the winding of yarn from the package at a winding station and which typically leads to ejection of the yarn package.

SUMMARY OF THE INVENTION

By the present invention, a method and apparatus are provided for removing an unsuccessfully pieced auxiliary yarn from the yarn package of a textile spinning machine prior to a subsequent yarn restarting operation so that no unpieced length of auxiliary yarn will remain on the package to interfere with proper unwinding and handling of the yarn in subsequent processing of the wound yarn package.

Briefly described, the method of the present invention provides for restarting the feed of yarn from a drafting device to a package building device to a package supported at a spinning station of a textile machine following a break in the feed of the yarn between the drafting device and the package. The method includes winding an auxiliary yarn onto the package, positioning the auxiliary yarn relative to the unwound yarn which has traveled beyond the drafting device prior to the yarn break to effect piecing of the auxiliary yarn with the unwound yarn, detecting the success of the piecing of the auxiliary yarn and the unwound yarn, and, in response to the detection of the failure of the auxiliary yarn to piece with the unwound yarn after a predetermined time, removing the unsuccessfully pieced auxiliary yarn from the package.

Preferably, the method includes applying suction to the package to effect loosening and removal of the unsuccessfully pieced auxiliary yarn, and directing yarn loosening air against the package to facilitate loosening of the unsuccessfully pieced auxiliary yarn from the package. In addition, the method preferably includes sensing the unsuccessfully pieced auxiliary yarn as it is removed from the package and cutting the removed auxiliary yarn in response to the sensing that the unsuccessfully pieced auxiliary yarn has been completely removed from the package.

In the apparatus of the present invention, means are provided for detecting failure of the auxiliary yarn to successfully piece with the unwound yarn, and means are further provided for removing unsuccessfully pieced auxiliary yarn from the package in response to the detection by the detecting means of the failure of the auxiliary yarn to piece with the unwound yarn.

Preferably, the removing means includes means for applying suction to the package to effect dislodgement and removal of the unsuccessfully pieced auxiliary yarn from the package, and means for directing yarn loosening air against the package to facilitate removal of the unsuccessfully pieced auxiliary yarn by the suction applying means.

Also preferably, the apparatus includes sensing means operable to sense the presence of yarn traveling therepast during removal of the unsuccessfully pieced auxiliary yarn by the suction applying means, and control means for effecting de-energization of the suction applying means upon sensing by the sensing means of the travel therepast of the complete length of the unsuccessfully pieced auxiliary yarn. In this embodiment, cutting means are provided for cutting the extent of yarn removed by the suction applying means in response to sensing by the sensing means of the travel therepast of at least a complete length of the unsuccessfully pieced auxiliary yarn.

In one form of the apparatus of the present invention, the detecting means is operable to detect the travel therepast of unpieced auxiliary yarn prior to successful piecing with the unwound yarn and the travel therepast of both the auxiliary yarn and the unwound yarn after the auxiliary yarn has successfully pieced with the unwound yarn. In this form of the present invention the removing means is operable to remove the length of auxiliary yarn wound on the package in response to the detecting by the detecting means of unpieced auxiliary yarn after the lapse of a predetermined length of time during which auxiliary yarn has been delivered to the package. The removing means include means for cutting the auxiliary yarn operable to cut the unpieced auxiliary yarn in coordination with the removal thereof from the package to thereby ready the package for receiving another length of auxiliary yarn.

BRIEF DESCRIPTION OF THE DRAWING

The sole drawing is a schematic side elevational view of the preferred embodiment of the package preparing apparatus of the present invention mounted on a traveling service unit and disposed for preparing the package of a spinning station of a textile spinning machine.

DETAILED DESCRIPTION OF THE PREFERRED EMBODIMENT

In the sole drawing, the preferred embodiment of the package preparing apparatus of the present invention is shown in its operating disposition for preparing a yarn package 14 for a yarn restarting operation. The yarn package 14 is supported on a spindle 13 of a spinning station of a textile spinning machine. The spindle 13 is drivingly rotated by a spindle drive motor 15 to selectively rotate the yarn package 14 in a winding and an unwinding direction. The spinning station includes a drafting device 10 through which yarn to be wound on the yarn package 14 is drafted, a yarn guide 11 for guiding the yarn traveling from the drafting device 10 and a package building device in the form of a ring rail 12 for guiding the yarn traveling from the yarn guide 11 onto the yarn package 14 in a package building motion. The ring rail 12 includes a conventional ring traveler (not shown) mounted for rotation about the axis of the yarn package 14 to guide yarn onto the yarn package. A suction device 16 having an opening position adjacent the downstream end of the drafting device 10 relative to the direction of travel of the yarn therethrough is operable to engage the end of the still-to-be-wound yarn following a yarn break.

A traveling service unit 17 is operable to travel to and between the spinning stations of the textile spinning machine to perform various servicing operations thereat including a yarn restarting operation in which the feed of yarn to a yarn package of a spinning station is restarted following a yarn break. The traveling service unit 17 can be configured in conventional manner to respond to the receipt of a signal from a particular spinning station which indicates that a break in feed of yarn to the yarn package being built thereat has occurred. Alternatively, the traveling service unit 17 can be provided with a detecting device 18 for detecting the occurrence of a yarn break at a spinning station. The detecting device 18 can be configured as a conventional tactile or photoelectric beam sensor which detects the presence or absence of a yarn traveling therepast.

To perform a yarn restart operation, the traveling service unit 17 is provided with a supply of auxiliary yarn 21 in the form of a conically-wound yarn package 20. A delivery arm 24 is pivotally connected by a pivot connection 25 to the traveling service unit 17 and includes a free end at which a roller 22 is freely rotatably mounted. The pivot connection 25 permits pivoting of the delivery arm 24 about an axis extending horizontally generally parallel to the direction of travel of the traveling service unit 17. Additionally, the pivot connection 25 is mounted on a conventional device (not shown) operable to move the pivot connection 25 and the delivery arm 24 in a lateral direction transverse to the direction of travel of the traveling service unit 17 toward and away from the spinning station being serviced by the traveling service unit. The delivery arm 24 is operatively connected to a control unit 19 which controls the movement of the delivery arm 24. A conventional yarn-cutting device 23 is mounted to the delivery arm 24 at a spacing from the roller 22 and is operatively connected to the control unit 19. The delivery arm 24 is positioned relative to the auxiliary yarn supply package 20 for guiding the auxiliary yarn 21 laterally outwardly relative to the traveling service unit 17 in a travel path along the delivery arm extending adjacent the yarn-cutting device 23 and the roller 22.

The traveling service unit 17 includes conventional means (not shown) of the type representatively disclosed in U.S. Pat. No. 3,591,951 for engaging the end of the auxiliary yarn 21 and disposing the end of the auxiliary yarn adjacent the yarn package 14 with the auxiliary yarn disposed in the yarn guide 11 and extending therefrom through the ring traveler of the ring rail 12 for subsequent engagement thereby. Additionally, the conventional yarn-engaging and disposing means disposes the end of the auxiliary yarn 21 relative to the yarn package 14 such that the auxiliary yarn end is engaged by the yarn package upon the resumption of winding rotation of the yarn package during the yarn restart operation and the conventional yarn engaging and disposing means disposes the auxiliary yarn 21 relative to the ring traveler of the ring rail 12 such that the auxiliary yarn is engaged by the ring traveler in correspondence with the engagement of the auxiliary yarn end by the yarn package 14.

In the event of a break in the yarn traveling from the drafting device 10 onto the yarn package 14, the traveling service unit 17 travels to the respective spinning station at which the yarn break has occurred. The detecting device 18 detects the absence of the yarn traveling therepast and transmits a corresponding signal to the control unit 19. The spinning station is alerted to the occurrence of a yarn break, for example, by a signal from a conventional stop motion device (not shown) and, in response thereto, the suction means 16 is energized to apply a suction to the extent of still-to-be-wound yarn which has traveled through the drafting device 10 to hold the unwound yarn in a disposition for subsequent piecing with the auxiliary yarn 21. Additionally, the spindle drive motor 15 is de-energized in correspondence with the detection of a yarn break to effect cessation of the winding rotation of the yarn package 14, which typically continues to rotate due to inertia to completely wind the unwound extent of the yarn below the yarn break location.

In response to the detection by the detecting means 18 that no yarn extends between the drafting device 10 and the yarn package 14, the control unit 19 of the traveling service unit 17 initiates a yarn restarting operation by controlling the conventional yarn engaging and disposing means to unwind an extent of the auxiliary yarn 21 from the auxiliary yarn package 20 and dispose the unwound extent in a travel path extending over the roller 22 on the delivery arm 24 and through the yarn guide 11 and the ring rail 12 such that the end of the auxiliary yarn is positioned adjacent the yarn package 14 for engagement thereby upon renewed winding rotation of the yarn package. The spindle drive motor 15 is then energized to rotate the yarn package 14 in the winding direction whereupon the end of the auxiliary yarn 21 is engaged by the outer surface of the yarn package 14 and wound thereon.

During the winding of the auxiliary yarn 21 onto the yarn package 14, the delivery arm 24 is manipulated to dispose its roller 22 in a piecing position adjacent the still-to-be-wound yarn extending between the drafting device 10 and the suction means 16 in which the auxiliary yarn 21 engages the unwound yarn and is pieced therewith. If the auxiliary yarn successfully pieces with the still-to-be-wound yarn, the still-to-be-wound yarn is drawn by the auxiliary yarn through the yarn guide 11 and the ring traveler of the ring rail 12 and is thereby fed onto the yarn package 14. After the lapse of a predetermined period of time following the disposition of the auxiliary yarn 21 for piecing engagement with the still-to-be-wound yarn, the control unit 19 controls the yarn-cutting means 23 to cut the auxiliary yarn 21 and the yarn winding operation continues in normal manner. The control unit 19 then controls the delivery arm 24 to move laterally away from the spinning station and the yarn restarting operation is now concluded whereupon the traveling service unit 17 is ready to travel to another spinning station for performing another servicing operation.

In the event that the auxiliary yarn 21 fails to successfully piece with the still-to-be-wound yarn, the severed auxiliary yarn 21 is wound onto the yarn package 14 without any corresponding following winding of the still-to-be-wound yarn onto the package. In this condition, the still-to-be-wound yarn has still not been reengaged with the yarn of the yarn package 14 and resumption of normal package building operation is still not possible. However, operator intervention may be premature if, in a subsequent yarn restarting operation, the auxiliary yarn 21 can be successfully pieced with the still-to-be-wound yarn. Nonetheless, even if a subsequent yarn restarting operation is successful, the unsuccessfully pieced yarn length of the initial unsuccessful yarn restarting operation will still remain on the yarn package 14 and thereby pose an increased risk of operational difficulties during subsequent handling of the yarn package 14 including, for example, the risk that both the yarn end of the yarn originally wound on the package prior to the yarn break and the yarn end of the unsuccessfully pieced yarn length will be engaged by a yarn end preparation device with consequent snarling and/or looping of the yarn.

The package preparing apparatus of the present invention is accordingly provided with means for removing an unsuccessfully pieced auxiliary yarn length from the yarn package 14. The removing means includes a suction applying means in the form of a suction conduit 29 and a yarn loosening air applying mean in the form of an air jet 26. The suction conduit 29 is operatively connected to a conventional suction source (not shown) and has a conically-shaped open end adapted to be disposed adjacent the top of the yarn package 14 to apply a yarn engaging suction to the yarn package. The suction conduit 29 is connected to a conventional movable support member 30 mounted on a traveling service unit 17 which is operable to move the suction conduit in a vertical direction and in a lateral direction toward and away from the spinning station being serviced by the traveling service unit 17. A sensor 31, which can be, for example, a conventional tactile sensor or photoelectric sensor, is disposed downstream of the conical open end of the suction conduit relative to the suction flow for sensing the travel therepast of a yarn engaged by the suction conduit. A conventional yarn cutting means 32 is mounted on the suction conduit 29 at a location intermediate the sensor 31 and the open end of the suction conduit for cutting a yarn drawn into the suction conduit. The sensor 31 and the yarn cutting-means 32 are each operatively connected to the control unit 19.

The air jet 26 is in the form of a conduit for directing a stream of pressurized air upwardly and generally tangentially against the outer windings of the yarn package 14 to facilitate loosening of a yarn end thereon. The air jet 26 is operatively connected to a conventional source of pressurized air (not shown) mounted on the traveling service unit 17 and is supported by a conventional movable support member 28 which is mounted to the traveling service unit 17 by appropriate conventional securement means such as, for example, conventional pivot connecting means, and which is operable to move the air jet 26 in a vertical direction and in a lateral direction toward and away from the spinning station. The movable support member 28 is operatively connected to the control unit 19.

A position sensor 27, which is only schematically shown in drawings, is mounted on the traveling service unit 17 for sensing the position of the ring rail 12. The position sensor 27 is operatively connected to the control unit 19 for providing information thereto to be evaluated by the control unit 19 in controlling the positioning of the air jet 26 to a position out of interference with the ring rail 12.

In one yarn removal operational sequence of the present invention, the package preparing apparatus operates as follows to prepare the yarn package 14 for subsequent yarn restarting operation following a prior yarn restarting operation in which a cut auxiliary yarn length, which did not successfully piece with the still-to-be-wound yarn, remains wound on the package. The suction conduit 29 and the air jet 26, which are each initially disposed in their respective retracted positions in which they are out of interference with the components of the spinning station being serviced by the traveling service unit 17, are controlled by the control unit 19 to move to their respective operating positions. The suction conduit 29 is moved laterally toward the spinning station to generally align its conical open end with the yarn package axis above the top of the yarn package 14 and the suction conduit is then lowered to dispose its conical open end relatively closely adjacent the exposed top end of the tube of the yarn package 14. The air jet 26 is moved laterally toward the spinning station and the control unit 19 controls the movement of the air jet 26 based upon information received from the position sensor 27 concerning the relative position of the ring rail 12 and the traveling service unit 17. The control unit 19 controls the movement of the air jet 26 to position the opening of the air jet relatively closely adjacent the upper portion of the yarn wound on the yarn package 14 for directing an upward and tangential stream of air against the outer windings of the yarn package.

In correspondence with the disposition of the suction conduit 29 and the air jet 26 in their respective operating positions, the control unit 19 controls the conventional suction source to apply suction through the suction conduit 29 and controls the conventional pressurized air source to supply air through the air jet 26 to be directed against the yarn package 14. The combined actions of the suction applied through the suction conduit 29 and the air stream directed against the yarn package 14 by the air jet 26 act to loosen and dislodge the unsuccessfull pieced yarn length which has been wound on the yarn package 14. Once dislodged, the unsuccessful pieced auxiliary yarn length is drawn along the suction conduit 29 due to the suction applied through the conduit and travels to a disposed location (not shown) on the traveling service unit 17. The sensor 31 senses the travel therepast of the unsuccessfully pieced auxiliary yarn length and transmits this sensed information to the control unit 19. After a predetermined lapse of time, which can be calculated by the control unit 19 based upon information, for example, received from the sensor 18 regarding the extent of the unsuccessfully pieced auxiliary yarn length wound on the yarn package 14, the control unit 19 de-energizes the conventional suction source and the conventional pressurized air source when the sensed information received from the sensor 31 indicates that the entire extent of the unsuccessfully pieced auxiliary yarn length has been unwound from the yarn package 14.

In anticipation that the combined suction and tangential air forces on the yarn package 14 may also effect loosening and dislodgement of the yarn wound on the yarn package prior to the yarn break and that such dislodged yarn would also be drawn into the suction conduit 29, the control unit 19 is configured to control the yarn-cutting means 32 to cut the previously wound yarn which has been suctioned into the suction conduit 29 after the control unit 19 has determined, based upon sensed information received from the sensor 31, that the entire extent of the unsuccessfully pieced auxiliary yarn length has already traveled past the sensor 31. In correspondence with the cutting action of the yarn-cutting means 32, the spindle drive motor 15 is energized to rotate the yarn package 14 in the yarn-winding direction to wind any uncut yarn in the suction conduit 29 back onto the yard package 14.

During the removal of the unsuccessfully pieced auxiliary yarn length from the yarn package 14, the spindle 13 is preferably maintained in a non-rotating disposition. This can be accomplished, for example, by a conventional brake-actuating means (not shown) mounted on the traveling service unit 17 which is controlled by the control unit 19 to actuate a spindle brake (not shown) associated with the spindle 13 on which the yarn package 14 is mounted and/or to effect de-energization of the spindle drive motor 15.

In correspondence with the completion of the removal of the unsuccessfully pieced auxiliary yarn length from the package 14, the control unit 19 controls the conventional yarn engaging and disposing means to dispose the end of the auxiliary yarn 21 adjacent the yarn package 14 in preparation for the execution of another yarn restarting operation. Since the unsuccessfully pieced auxiliary yarn length disposed on the yarn package during the prior yarn restarting operation has been completely removed from the yarn package, another length of the auxiliary yarn 21 can be wound on the yarn package 14 during the subsequent yarn restarting operation without the risk that there will still be an unpieced auxiliary yarn length remaining on the yarn package which could potentially interfere with subsequent handling operations of the yarn package.

According to another variation of the yarn restart operation performed in accordance with the present invention, the auxiliary yarn 21 is wound on the yarn package 14 but is not severed by the yarn-cutting means 23 on the delivery arm 24 until the control unit 19 has determined that the auxiliary yarn has successfully pieced with the still-to-be-wound yarn, the yarn extending beyond the drafting device 10 and engaged by the suction conduit 16. In this variation of the yarn restarting operation, the conventional yarn engaging and disposing means is controlled by the control unit 19 to dispose the auxiliary yarn 21 in the yarn guide 11 and to dispose the end of the auxiliary yarn adjacent the yarn package 14 for engagement thereby. The yarn package 14 is then rotated in the winding direction to thereby engage the closely adjacent end of the auxiliary yarn 21 and wind the auxiliary yarn thereon. In correspondence with the winding of the auxiliary yarn 21 onto the yarn package 14, the delivery arm 24 is pivoted about its pivot connection 25 and moved laterally toward the spinning station to dispose its roller 22 in rotation transmitting engagement with a lower roller of the forwardmost pair of upper and lower rollers of the drafting device 10 relative to the direction of travel of the yarn therethrough. The rotation of the associated lower roller rotates the roller 22 to facilitate the unwinding of the auxiliary yarn 21 from the auxiliary yarn package 20.

In this variation of the present invention, the sensor 18 is provided with the conventional capability to detect the travel therepast of a single yarn, such as the auxiliary yarn 21 before piecing with the still-to-be-wound yarn, and the travel therepast of a yarn of increased volume, such as the yarn resulting from the pieced together auxiliary yarn 21 and the still-to-be-wound yarn drafted through the drafting device 10. Thus, the sensor 18 senses the travel therepast of the auxiliary yarn 21 as well as the travel therepast of the still-to-be-wound yarn if the auxiliary yarn has successfully pieced the still-to-be-wound yarn. In the event that the control unit 19 receives sensed information from the sensor 18 which indicates that the auxiliary yarn 21 has successfully pieced with the still-to-be-wound yarn, the control unit 19 controls the yarn-cutting means 23 on the delivery arm 24 to cut the auxiliary yarn 21 and package building operation then continues in normal manner.

On the other hand, if the auxiliary yarn 21 has not successfully pieced with the still-to-be-wound yarn drafted through the drafting device 10 after a predetermined lapse of time, the control unit 19 will continue to receive sensed information from the sensor 18 which indicates that only the auxiliary yarn 21 is traveling therepast. In this event, the control unit 19 does not control the yarn-cutting means 23 to cut the auxiliary yarn 21 but, instead, controls the delivery arm 24 to move its roller 22 to a disposition in which the roller 22 is positioned in rotation transmitting engagement with an upper roller of the forwardmost rollers of the drafting device 10. The respective upper roller, which rotates in a direction opposite to the lower roller of the roller pair, rotates the roller 22 in a rotation direction which effects unwinding of the auxiliary yarn 21 from the yarn package 14.

The control unit 19 controls the delivery arm 24 to maintain the roller 22 against the respective upper roller of the drafting device 10 for a sufficient period of time for the roller 22 to completely unwind the length of the auxiliary yarn 21 which had previously been wound onto the yarn package 14. The now unwound extent of the auxiliary yarn 21 can be drawn by a suction force into a conventional suction conduit (not shown) mounted on the traveling service unit 17 and, in correspondence therewith, the control unit 19 controls the yarn-cutting means 23 to cut the auxiliary yarn length. The cut yarn length is then suctioned away to a disposal location by the conventional suction conduit. The control unit 19 can thereafter initiate a subsequent yarn restarting operation.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. A method for restarting the feed or yarn from a drafting device through a package building device to a yarn package supported at a spinning station of a textile machine, the restarting of the feed of yarn being performed to restart the winding of a package following a break in the yarn being fed to the package, the break in the yarn resulting in an end of unwound yarn which has been drafted through the drafting device and a trailing end of yarn which has already been wound on the package, the method comprising:

delivering one length of auxiliary yarn to the package with the end of the one length of auxiliary yarn being freely disposed on the package independent from the trailing end of the already wound yarn;

disposing the one length of auxiliary yarn relative to the unwound yarn end for piecing therewith such that the one length of auxiliary yarn thereafter draws the unwound yarn pieced therewith onto the package as the one length of auxiliary yarn is wound on the package;

detecting the failure of the one length of auxiliary yarn to successfully piece with the unwound yarn end after a predetermined time period;

removing the one length of auxiliary yarn completely from the package in response to the detection of the failure of the one length of auxiliary yarn to piece with the unwound yarn end; and delivering another length of auxiliary yarn to the package in response to detection of the failure of the one length of auxiliary yarn to piece with the unwound yarn end, the delivering of the another length of auxiliary yarn to the package being coordinated with the completion of the removal of the one length of auxiliary yarn from the package.

2. The method according to claim 1 and characterized further in that the removing of the one length of auxiliary yarn from the package includes applying suction to the package to effect loosening and removal of the unsuccessfully pieced auxiliary yarn.

3. The method according to claim 2 and characterized further in that the removing of the one length of auxiliary yarn from the package includes directing yarn loosening air against the package to facilitate loosening of the one length of auxiliary yarn from the package.

4. The method according to claim 3 and characterized further by sensing the one length of auxiliary yarn as it is removed from the package during removal of the one length of auxiliary yarn in response to the detection of the failure of the one length of auxiliary yarn to piece with the unwound yarn end and cutting a length of yarn which may have been drawn off of the package by the one length of auxiliary yarn during the removal of the one length of auxiliary yarn in response to the sensing that the one length of auxiliary yarn has been completely removed from the package.

5. A yarn restarting system for performing a yarn restarting operation at the spinning station of a textile spinning machine at which yarn is drafted through a drafting device and is thereafter fed by a package building device onto a package, the yarn restarting operation being performed to restart the winding of a package following a break in the yarn being fed to the package from the drafting device, the break in the yarn resulting in an end of unwound yarn which has been drafted through the drafting device and a trailing end of yarn which has already been wound on the package, the yarn restarting system comprising:

means for delivering lengths of auxiliary yarn to the package, the delivering means delivering an end of each delivered length of auxiliary yarn for engagement by the package with the end of the delivered length of auxiliary yarn being freely disposed on the package independent from the trailing end of the already wound yarn;

means for disposing one length of auxiliary yarn relative to the unwound yarn end for piecing therewith such that the one length of auxiliary yarn thereafter draws the unwound yarn pieced therewith onto the package as the one length of auxiliary yarn is wound on the package;

means for detecting the failure of the one length of auxiliary yarn to successfully piece with the unwound yarn end after a predetermined time period;

means for removing the one length of auxiliary yarn completely from the package in response to the detection by the detecting means of the failure of the one length of auxiliary yarn to piece with the unwound yarn end; and control means for controlling, in response to the detection by the detecting means of the failure of the one length of auxiliary yarn to piece with the unwound yarn end, the delivering means to deliver another length of auxiliary yarn to the package building device for subsequent feeding thereof onto the package and the disposing means to dispose the another length of auxiliary yarn relative to the unwound yarn end for piecing therewith, the control means controlling the delivering means to deliver the another length of auxiliary yarn to the package in coordination with the completion of the removal of the one length of auxiliary yarn from the package by the removing means.

6. In a yarn restarting system, the package preparing apparatus according to claim 5 and characterized further in that said removing means includes means for applying suction to the package to effect dislodgement and removal of the unsuccessfully pieced auxiliary yarn from the package.

7. In a yarn restarting system, the package preparing apparatus according to claim 6 and characterized further by sensing means operable to sense the presence of yarn traveling therepast during removal of the unsuccessfully pieced auxiliary yarn by said suction applying means, and control means for effecting deenergization of said suction applying means upon sensing by said sensing means of the travel therepast of the complete length of the unsuccessfully pieced auxiliary yarn 8. In a yarn restarting system, the package preparing apparatus according to claim 7 and characterized further by cutting means, operatively connected to said sensing means, for cutting the extent of yarn removed by said suction applying means in response to sensing by said sensing means of the travel therepast of at least the complete length of the unsuccessfully pieced auxiliary yarn.

9. In a yarn restarting system, the package preparing apparatus according to claim 6 and characterized further by means for directing yarn loosening air against the package to facilitate removal of the unsuccessfully pieced auxiliary yarn by said suction applying means.

* * * * *